United States Patent [19]

Hendricks

[11] 3,959,831

[45] June 1, 1976

[54] WASH BASIN DRAIN FILTER

[76] Inventor: Jon Michael Hendricks, 600 Church Hill Road, La Habra, Calif. 90631

[22] Filed: Dec. 16, 1974

[21] Appl. No.: 532,753

[52] U.S. Cl. ..... 4/287; 4/295; 4/DIG. 14; 210/460

[51] Int. Cl.[2] ..... A47K 1/14

[58] Field of Search ..... 210/460; 4/204, 287, 4/288, 291, 292, 295, DIG. 14

[56] References Cited

UNITED STATES PATENTS

| | | | |
|---|---|---|---|
| 214,983 | 5/1879 | Atwater | 4/287 |
| 302,110 | 7/1884 | Danziger | 4/287 |
| 313,068 | 3/1885 | Gage | 4/287 |
| 2,475,048 | 7/1949 | Potras | 4/287 X |
| 2,984,359 | 5/1961 | O'Brien | 210/460 X |
| 3,110,323 | 11/1963 | Helsupra | 4/287 X |
| 3,125,764 | 3/1964 | Young | 4/204 |
| 3,435,597 | 4/1969 | Levy | 210/460 X |
| 3,696,033 | 6/1971 | DeLano et al. | 210/460 |

*Primary Examiner*—Theodore A. Granger
*Attorney, Agent, or Firm*—Edgar W. Averill, Jr.

[57] ABSTRACT

A wash basin drain filter for entrapping elongated flexible fibers such as hair while permitting the passage of relatively small particulate matter is disclosed herein. The filter has a generally cylindrical body which, after installation, about the shank of a pop-up drain plug has a plurality of spikes protruding outwardly therefrom. The spikes are resilient to permit insertion of the filter into the drain opening and, after insertion, the spikes extend to touch or nearly touch the inside wall of the drain pipe into which the filter has been inserted.

13 Claims, 5 Drawing Figures

WASH BASIN DRAIN FILTER

BACKGROUND OF THE INVENTION

The field of the invention is plumbing fixtures, more specifically, the invention relates to wash basin drain plug screens or filters which have as their major function the prevention or reduction of drain clogs caused by solid matter passing into the drain opening.

Various means are used to help reduce the tendency of wash basin drains to become stopped up in use. Pop-up drain plugs are typically designed to open sufficiently to permit water and small particles to pass down the drain but prevent larger objects from such passage as a result of the relatively small opening between the lower surface of the drain plug and the upper surface of the drain pipe. Various perforated cylinders are often used in connection with such drain plugs to further help prevent particles from clogging the drain. While the pop-up drain valve is effective in preventing the passage of large particles and foreign objects, it does not prevent the passage of hair and other elongated flexible fibers. While basket devices or strainers are generally effective to collect hair and the like, such devices become readily clogged and soon prevent the passage of water, thereby defeating the ultimate purpose of keeping the drain free from clogging.

SUMMARY OF THE INVENTION

The present invention is for a wash basin drain filter for entrapping elongated flexible fibers such as hair while permitting the passage of relatively small particulate matter and water. The filter has a generally cylindrical body which is adapted to fit about the shank of a pop-up drain plug. A plurality of spikes are affixed to the body and protrude outwardly. The spikes are resilient either because they themselves are fabricated from a flexible material or because they are resiliently mounted to the body thereby permitting the filter to be inserted through a relatively small drain opening while still resulting in the spikes touching or coming close to the outer wall of the drain pipe after insertion of the filter. Spikes located in two or more horizontal planes about a vertical shank have been found most effective to entrap hair and the like while still permitting the passage of water and other small particles.

DESCRIPTION OF THE PREFERRED EMBODIMENTS

Figure 1:
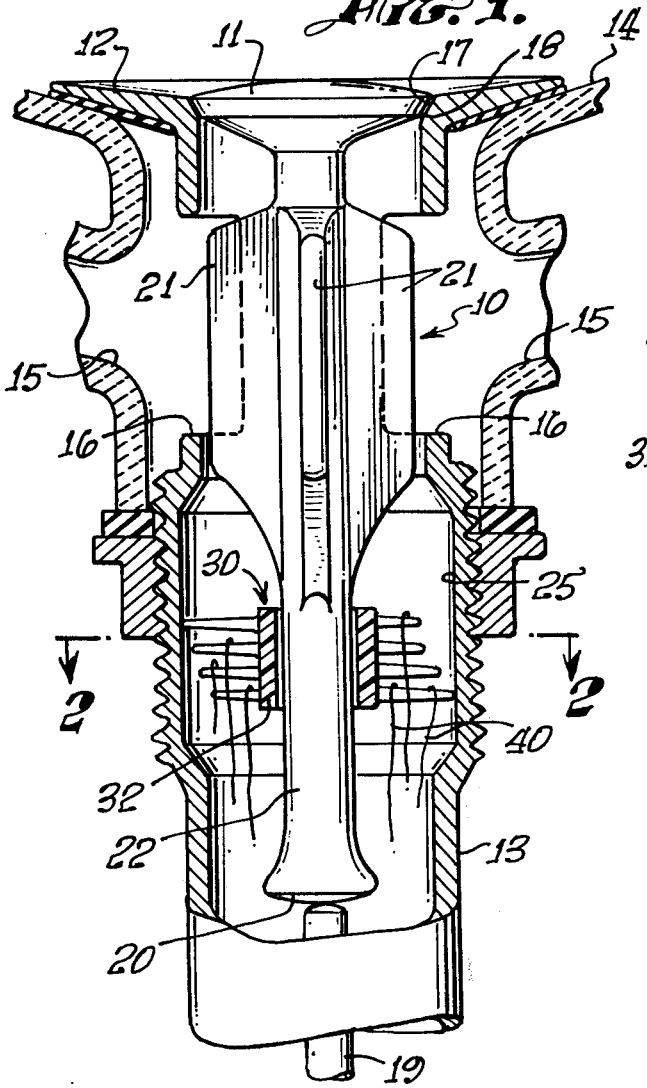
FIG. 1 is a side elevation, partly in cross section, of a wash basin drain and plug equipped with the filter of the present invention.

A pop-up drain plug indicated generally by reference character 10 is shown in FIG. 1. Plug 10 has a top 11 which forms a water-tight engagement with a flared flange 12 which is an integral portion of drain body 13. Drain body 13 is sealingly installed in basin 14 in a conventional manner.

Basin 14 may be of the type which has an overflow port 15 which is connected to a passageway leading to an opening in the upper portion of the basin, not shown, to enable the draining of water when the basin is inadvertently permitted to overflow. Port 15 is connected through drain body 13 and the overflow, if any, flows through opening 16 in body 13. A seal between drain plug 10 and flange 12 is formed between valve face 17 located at the lower surface of top 11 and valve face 18 located along the upper surface of flange 12. Drain plug 10 is caused to move vertically by contact with push rod 19 which contacts an enlarged end portion 20 of drain plug 10. Four guides 21 are positioned about the upper sides of drain plug 10 and a cylindrical shank 22 is located between the lower extremity of guides 21 and the upper extremity of the enlarged end portion 20. Drain body 13 may have an enlarged interior area 25.

A filter of the type of the present invention is shown in cross section in FIG. 1 and indicated generally by the reference character 30. A plurality of elongated spikes 31 extend outwardly from a cylindrical body 32 which is held about shank 22 of drain plug 10.

Figure 2:
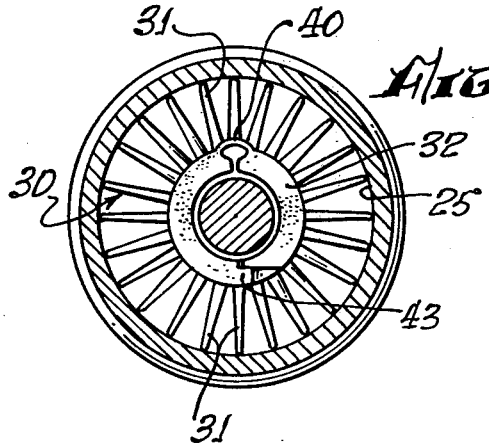
FIG. 2 is a plan elevation taken along line 2—2 of FIG. 1.

The filter 30 of FIG. 1 is shown in plan view in FIG. 2. The spikes 31 extend to the inside enlarged interior area 25 of drain body 13. The cylindrical body 32 of filter 30 surrounds cylindrical shank 22 of drain plug 10.

Returning to FIG. 1, a plurality of hairs 40 are shown entrapped on spikes 31. After being in use, drain plug 10 may be removed by lifting upwardly on top 11 in a conventional manner and filter 30 holds and draws out flexible elongated members such as hairs to enable the user to remove the same without having them plug up the drain.

Figure 3:
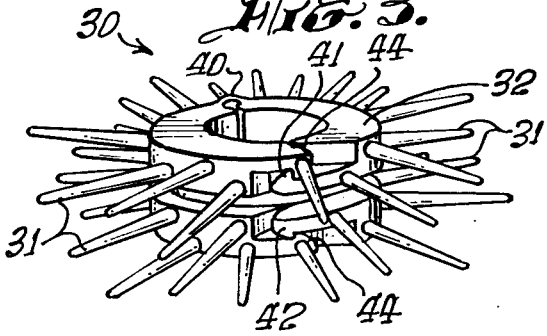
FIG. 3 is a perspective view of the filter of the present invention.

The positioning of the spikes on filter body 32 is shown in FIG. 3. It is preferable that the spikes be located in a plurality of planes which are perpendicular to the central axis of body 32. It is also preferable that the spikes in one plane are located in a different axial position from the spikes in the adjacent plane or planes. In this way, the spikes are more effective in entrapping hairs and yet do not prevent the passage of relatively small particulate matter. The positioning of the spikes in a generally spiral configuration in the manner shown in FIG. 3 is a particularly effective pattern for the entrapment of elongated members.

Figure 5:
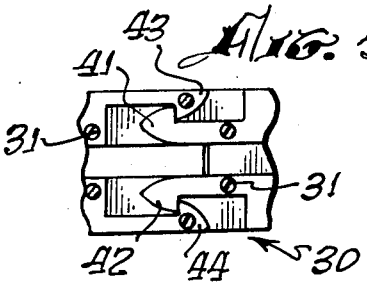
FIG. 5 is a side elevation of the latch of the filter of FIG. 3.
Figure 4:
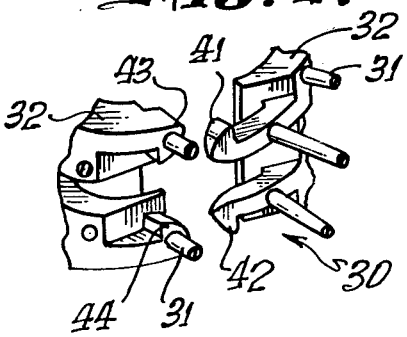
FIG. 4 is an enlarged fragmentary view of the latch of the filter of FIG. 3 in an unlatched configuration.

For most drain plugs, the enlarged end portion 20 thereof is integrally molded with the cylindrical shank 22. In such cases, it is necessary that cylindrical body 32 of filter 30 be capable of installation about cylindrical shank 22. This may be accomplished either by forming the body from an elastic material such as rubber or by providing means to permit the body 32 to open and accept cylindrical shank 22. One such means is shown in the filter shown in the drawings. Hinge means 40 is molded into the side of body 32 which readily permits the body to swing open. A pair of inner latches, 41 and 42 interconnect with a pair of outer latches 43 and 44 to hold body 32 in a securely closed position. Body 32 is shown in an unlatched configuration in FIG. 4 and in a latched configuration in FIG. 5.

Although the latch may be opened by pressing inner latches 41 and 42 together, it is generally unnecessary to remove the filter from the shank after it is once installed. Although the latch shown in the drawings is a particularly effective design for the present purpose, the filter may use any other configuration of latch as long as it tends to stay in a closed position after long immersion in hot, soapy water. Alternatively, the body could be molded from a flexible rubber such as neoprene.

By fabricating the spikes so that they about touch the inside surface of the drain and by locating the spikes in close proximity to one another, the filter of the present invention will retain objects such as rings which are inadvertently dropped down the drain. Particles such as sand readily pass through the filter.

Elongated spikes 31 should be adapted to permit the insertion of the filter through the smaller neck of drain body 13 while still causing them to flex outwardly to about touch the enlarged interior area 25. This may be accomplished either by forming the spikes from a flexible material, by forming the body from a flexible material, or by a combination of both of these. The spikes may either be integrally molded with body 32 or may be inserted through body 32. Because of the economy available by the use of injection molding, it is believed that integrally formed spikes provide the most economical means for fabricating the filter of the present invention.

The filter may be molded from any material which is capable of withstanding the environment existing in the drain. Plastics such as polyethylene, acrylonitrile-butadiene-styrene, polyvinyl chloride, nylon or the like or rubber-like materials such as neoprene may also be used.

The positioning of the spikes although shown in the drawings as extending radially from the center axis of the filter body, could as well be placed generally tangentially to the outer surface of the body. It is merely important that there be a plurality of spikes positioned between the filter body and the interior area 25 of the drain body. The filter should be also readily removable from the drain and thus it is preferable that the spikes be mounted on an inner cylindrical body rather than along an outer cylindrical body.

It is also possible to form the drain plug and filter portions integrally. For instance, the plug and filter could be injection molded together as one piece rather than separate pieces as shown in the drawing.

The present embodiments of this invention are thus to be considered in all respects as illustrative and not restrictive, the scope of the invention being indicated by the appended claims rather than by the foregoing description. All changes which come within the meaning and range of equivalency of the claims therefore are intended to be embraced therein.

I claim:

1. A wash basin drain filter for entrapping elongated flexible fibers such as hair while permitting the passage of relatively small particulate matter and water, said filter comprising:

a pop-up drain plug having an upper enlarged top for forming a water tight seal with a wash basin, said drain plug having an elongated shank with a lower enlarged bottom end portion;

a filter member having a generally cylindrical body having an axially aligned opening positioned about the shank of a pop-up drain plug said opening being smaller than said enlarged top and said enlarged bottom end portion so that said member is held onto said drain plug; and a plurality of spikes affixed to said body and protruding outwardly therefrom, the outer extremities of said spikes being resiliently moveable from their relaxed position to a position closer to the longitudinal axis of said cylindrical body.

2. The filter of claim 1 wherein said opening in the body is enlargeable to enable insertion about said elongated shank of said pop-up drain plug.

3. The filter of claim 2 wherein said body is resiliently hinged.

4. The filter of claim 3 wherein said body has a clasp to hold said body in a closed configuration.

5. The filter of claim 1 wherein said spikes are located in at least two planes which are positioned at right angles to the central axis of said cylindrical body.

6. The filter of claim 5 wherein each spike is pointed in a different radial direction from every other spike.

7. The filter of claim 5 wherein said spikes are located in four of said planes.

8. The filter of claim 7 wherein there are six spikes in each of said planes.

9. The filter of claim 1 wherein said spikes and said body are integrally fabricated from a flexible elastomeric material.

10. The filter of claim 1 wherein said spikes are frustro-conical in shape.

11. A wash basin drain filter useful for entrapping hair and other elongated fibers while permitting the passage of particulate matter and water, said filter comprising:

a pop-up drain plug having a diametrically enlarged base, intermediate shank means and water stopper means positioned at the upper extremity thereof;

a hinged, hollow cylindrical body having an opening extending from the upper surface of said body to the lower surface thereof said body being positioned about a portion of said shank;

means for holding the opening in said body in a position to prevent said body from falling off said shank; and a plurality of radially extending spikes affixed to said body and extending outwardly therefrom in a generally horizontal position when the longitudinal axis of said body is in a vertical position.

12. The filter of claim 11 wherein said means for holding comprises latch means.

13. The filter of claim 12 wherein said latch means comprises a flexible pair of inner latch members shaped to mate with a pair of outer latch members.

* * * * *